US005615531A

United States Patent [19]

Nakai et al.

[11] Patent Number: 5,615,531

[45] Date of Patent: Apr. 1, 1997

[54] PACKING TAPE STICKING APPARATUS IN A SEALING MACHINE AND THE LIKE

[75] Inventors: Kiyooki Nakai; Shigeru Kita, both of Amagasaki, Japan

[73] Assignee: Sekisui Kagaku Kogyo Kabushiki Kaisha, Osaka, Japan

[21] Appl. No.: 563,088

[22] Filed: Nov. 27, 1995

[30] Foreign Application Priority Data

Nov. 25, 1994 [JP] Japan ..... 6-291111
Jul. 26, 1995 [JP] Japan ..... 7-190219

[51] Int. Cl.[6] ..... B65B 61/00

[52] U.S. Cl. ..... 53/136.4; 53/389.3; 156/468

[58] Field of Search ..... 53/135.1, 136.4, 53/389.3, 389.4, 137.2; 156/468, 475, 522; 83/563, 564, 556, DIG. 1

[56] References Cited

U.S. PATENT DOCUMENTS

| | | | |
|---|---|---|---|
| 4,590,736 | 5/1986 | Marchetti | 53/136.4 |
| 4,781,786 | 11/1988 | Lerner et al. | 53/136.4 |
| 4,821,487 | 4/1989 | James et al. | 53/136.4 |
| 4,889,581 | 12/1989 | Ulrich et al. | 53/136.4 |
| 5,121,586 | 6/1992 | Focke | 53/136.4 |
| 5,173,140 | 12/1992 | Vasilakes | 53/137.2 |
| 5,184,997 | 2/1993 | James et al. | 53/136.4 |
| 5,223,075 | 6/1993 | Sims | 156/468 |
| 5,511,362 | 4/1996 | Morita et al. | 53/136.4 |

FOREIGN PATENT DOCUMENTS

| | | | |
|---|---|---|---|
| 58-13411 | 3/1983 | Japan . | |
| 5065140 | 3/1993 | Japan | 53/136.4 |
| 1073157 | 2/1984 | U.S.S.R. | 53/136.4 |
| 2120201 | 11/1983 | United Kingdom | 53/136.4 |

*Primary Examiner*—John Sipos
*Assistant Examiner*—Ed Tolan
*Attorney, Agent, or Firm*—Armstrong, Westerman, Hattori, McLeland & Naughton

[57] ABSTRACT

The present invention discloses a packing tape sticking apparatus for jointing butt portions of two pieces of a sealing machine or a box construction machine and for jointing butt portions of two pieces of corrugated fibreboard containers, wherein a cutter is usually escaped to a storing position and is protruded to a cutting position only when a sealing operation is performed. When a tape sticking plate is located in a sticking position of the packing tape through a third elastic member, a first elastic member arranged between the cutter and a tape pressing member is under a natural condition which is not elastically transformed, and the cutter is escaped to the storing position by an urging force of a second elastic member arranged between the cutter and a side plate. On the other hand, when the tape sticking plate is pushed up against the urging force of the third elastic member by entering the box body, the first elastic member is pulled with the result that the cutter is protruded to the cutting position of the packing tape by the urging force of the first elastic member which is stronger than one of the second elastic member.

16 Claims, 16 Drawing Sheets

4

PACKING TAPE STICKING APPARATUS IN A SEALING MACHINE AND THE LIKE

BACKGROUND OF THE INVENTION

1. Field of the Invention

The present invention relates to a packing tape sticking apparatus for a sealing machine for a box body such as corrugated fibreboard container and a box construction machine and for jointing butt portions of two pieces of corrugated fibreboard containers.

2. Description of the Prior Art

As shown in FIG. 14, a sealing machine is conventionally well-known, wherein products are packed in a constructed box body such as a corrugated fibreboard container C before inner flaps F1 respectively connected to upper ends of front and back faces thereof and outside flaps F2 respectively connected to upper ends of right and left sides thereof are folded down in turn and butt portions of F2 are sealed by a packing tape T such as an OPP tape and a craft tape. (See Japanese TOKKYO KOKOKU No. S58-13411.)

First, a sealing machine 1 is described according to FIG. 15 and FIG. 16. The sealing machine 1 comprises a base 2, a carrier device 3 which is arranged at the base 2 so as to carry a corrugated fibreboard container C backward, and a sticking apparatus 4 which seals butt portions of outside flaps of the corrugated fibreboard container C fed by the carrier device 3 by means of a packing tape T.

The base 2 includes support legs 21 which can move freely up and down and a planer-type frame 22 at the approximate center thereof, the support legs 21 are provided with rotatable casters 23. The planer-type frame 22 is provided with a guide 24 which is protruded forward to move freely up and down so as to keep the outside flaps F2 of the corrugated fibreboard container C folded into an inside thereof.

As a result, this enables the sealing machine 1 to move to a position neighboring to the conveyer device of the corrugated fibreboard container C packed with products and it also enables a carrying face of roller conveyers 31 of the carrier device 3 mentioned later to be adjusted in upward and downward directions so as to fit in a carrying face of the conveyer device of the corrugated fibreboard container C. Moreover, it enables the guide 24 to be adjusted in upward and downward directions according to a height of the corrugated fibreboard container C to be carried.

Furthermore, the carrier device 3 comprises a number of roller conveyers 31 which are rotatably arranged at the base 2 so as to carry the corrugated fibreboard container C to forward and backward directions of the base 2 (a carrying direction of the corrugated fibreboard container, or right and left directions in FIG. 15), and a pair of belt-conveyers without ends 32 which are arranged at both sides of right and left directions of the base 2 (a perpendicular direction to FIG. 15), one belt conveyer 32 can move forward and backward to the other belt-conveyer 32 according to a width of the corrugated fibreboard container C, which is not shown in details.

Therefore, the corrugated fibreboard container C led to the base 2 can be held between both sides by a pair of belt-conveyers 32 to be carried backward by means of being incorporated with roller conveyers 31.

On the other hand, as shown in details in FIG. 16, the sticking apparatus 4, in the same way as the aforementioned guide 24, comprises a pair of side plates 41 which are arranged at the planer-type frame 22 so as to move freely upward and downward and connected to each other with each space in right and left directions through a stay (not shown), a support arm 42 which is fixed in the side plate 41 so as to support a packing tape roll R rotatably, a tape sticking plate 43 which is located in an upper side of the side plate 41 to be rotatably supported, a cutter 44 for cutting a packing tape T, and a pressing roller 45 which is located in a lower side of the side plate 41 to be rotatably supported and presses the packing tape T which seals the butt portions of the outside flaps F2 of the corrugated fibreboard container C.

The support arm 42 comprises an arm body 421 fixed in the side plate 41 and a core 422 which is rotatably supported at an edge of the arm body 421 and can fit a winding core of the packing tape roll R and a roller 423 which is rotatably supported at a lower part of the arm body 421. The packing tape T of the packing tape roll R is drawn toward a tape sticking plate 43 mentioned later through the roller 423.

The tape sticking plate 43 comprises a sticking plate body 431 which is rotatably supported at surroundings of a pin **43*a* arranged at the side plate 41, a guide roller 432 which is rotatably supported at the sticking plate body 431 so as to guide the packing tape T, and a claw 433 for holding tape arranged at the sticking plate body 431, wherein the packing tape T drawn out from the packing tape roll R passes through a space which is formed by the sticking plate body 431 and the claw for holding tape 433 via the guide roller 432 before an adhesive surface thereof is faced upstream to be guided in a suspended state by passing over a lower edge of the sticking plate body 431**.

The cutter 44 comprises a cutter cam 441 in a state of plate which is rotatably supported at surroundings of a pin **44*a* arranged at a side plate 41, a cutter blade 442 fixed in the cutter cam 441, a spring 443 as an elastic member for pulling the cutter cam 441 to a direction in which the cutter blade 442 always cuts the packing tape T, and a stopper 444 for limiting a rotation of the cutter cam 441, wherein, in entering the corrugated fibreboard container C, a front face thereof is met with the cutter cam 441, thereby pushing up the cutter cam 441 against the pulling force of the spring 443, and when a back edge of the corrugated fibreboard container C passes through, the pulling force of the spring 443 makes it return to the position of the cutter to meet with the stopper 444**.

The cutter cam 441 is formed in a state of plate so as not to interfere with the aforementioned sticking plate body 431 and the packing tape T.

Moreover, the pressing roller 45 comprises a roller plate 451 which is rotatably supported at surroundings of a pin **45*a* arranged at the side plate 41, a roller 452 which is rotatably supported at an edge of the roller plate 451, and a spring 453 as an elastic member for pulling the roller 452 to a direction for contacting a surface of the corrugated fibreboard container C, wherein, in entering the corrugated fibreboard container C, the packing tape T which seals the butt portions of the outside flaps F2 of the corrugated fibreboard container C through the aforementioned tape sticking plate 43 is pressed by the roller 452 which is rotating owing to the pulling force of the spring 453**.

Furthermore, between an upper portion of the pressing roller 45 and an approximate center portion of the tape sticking plate 43, a connection rod 46 is laid so as to work with each other. In other words, when the corrugated fibreboard container comes in, the front face thereof is met with the sticking plate body 431 of the tape sticking plate 43 to make the sticking plate body 431 rotate downstream with the result that the connection rod 46 pushes the pressing roller 45 out to make the pressing roller 45 rotate upstream against the pulling force of spring 453.

In order to limit rotations of the pressing roller 45 and the tape sticking plate 43 pulled by the spring 453, a stopper which is not shown is arranged at the side plate 41.

Next, an operation of the sealing machine 1 formed as mentioned above is described. First, the guide 24 and the sticking apparatus 4 is moved upward and downward according to a height of the corrugated fibreboard container C and a space between a pair of belt-conveyers 32 is adjusted so as to fit in a space between right side and left side of the corrugated fibreboard container C approximately. After that, the corrugated fibreboard container C packed with products is entered, the corrugated fibreboard container C is carried downstream through roller conveyers 31 and belt-conveyers 32 which the carrier device 3 comprises. At that time, the outside flaps F2 of the corrugated fibreboard container C are pushed by the guide 24, thereby being kept to be folded. Then, the corrugated fibreboard container C is carried and the front face thereof is met with the sticking plate body 431 of the tape sticking plate 43 with the result that the packing tape T whose adhesive surface is hung to be faced upstream along the sticking plate body 431 is stuck, at the same time when the sticking plate body 431 is rotated downstream, thereby pushing it up. The rotation of the tape sticking plate 43 makes the pressing roller 45 rotate upstream through the connection rod 46 at the same time when the edge thereof reaches a portion close to an edge of the cutter blade 442 to prevent the packing tape T from touching the cutter blade 442.

When the corrugate fibreboard container C is carried downstream, the packing tape roll R rotates to draw the packing tape T and on the other hand, the front face of the corrugate fibreboard container C is met with the cutter cam 441 of the cutter 44, thereby making the cutter cam 441 rotate downstream against the pulling force of the spring 443 to push it up with the result that the cutter blade 442 is escaped upward so as to prevent the cutter blade 442 from touching the packing tape T. On the other hand, owing to the rotation of the tape sticking plate 43, the pressing roller 45 is pushed upstream against the pulling force of the spring 453 through the connection rod 46 and the roller 452 presses the packing tape T which is stuck to the butt portions of the outside flaps F2 of the corrugated fibreboard container C by the pulling force of the spring 453 to stick the packing tape T while rotating in pursuit of the carriage of the corrugated fibreboard container C.

As mentioned above, the butt portions of the outside flaps F2 of the corrugated fibreboard container C is stuck by the packing tape T in pursuit of the carriage of the corrugated fibreboard container C. In this case, even though a back end of the corrugated fibreboard container C passes through the tape sticking plate 43, the pressing roller 45 contacts an upper surface of the corrugated fibreboard container C with the result that the tape sticking plate 43 is in a position to be kept pushing up downstream. Furthermore, when the corrugated fibreboard container C is carried before the back end thereof is removed from the edge of the cutter cam 441, the cutter cam 441 is rotated upstream by the pulling force of the spring 443, whereby the cutter blade 442 cuts the packing tape T. Under a condition that the packing tape T is cut, the corrugated fibreboard container C is still carried with the result that the back end thereof is removed from the roller 452, the roller 452 is rotated backward by the pulling force of spring 453 to press the end portion of the packing tape T to a back face of the corrugated fibreboard container C to be stuck. On the other hand, the rotation of the pressing roller 45 makes the tape sticking plate 43 be pushed through the connection rod 46, whereby the cut packing tape T is hung while the edge thereof goes over the lower end of the sticking plate body 431, so as to be prepared for the carriage of the next corrugated fibreboard container C.

In such a sealing machine 1, the cutter cam 441 and the cutter blade 442 of the cutter 44 are always protruded over lower ends of the side plates 41 at the position of cutting the packing tape T by means of the pulling force of the spring 443, whereby, in case that it is required to insert a hand in the inside thereof in exchanging the packing tape rolls R, inspecting operation for safety and the like, an operator must put on safety gloves which are thick, leathern or threaded with metal meshes to perform an operation, thereby making it difficult for him to perform a delicate operation.

Therefore, in the above mentioned sealing machine 1, a cover (not shown) which covers the cutter blade 442 protruded over the lower ends of the side plates 41 is still rotatably supported, thereby pulling it to a position of covering the cutter blade 442 through the spring whose cover is usually not shown, and when the corrugated fibreboard container C is entered, first, the cover is pushed up against the pulling force of the spring before the cutter cam 441 is pushed up.

However, even if the cutter blade 442 is covered with a cover, it is not changed that the cutter blade 442 is protruded to the cutting position over the lower ends of the side plates 41. Then, taking a case in which the cover is pushed up owing to some reason into consideration, it is required for an operator to wear the safety gloves.

SUMMARY OF THE INVENTION

In order to overcome the above conventional problems, an object of the present invention is to provide a packing tape sticking apparatus in a sealing machine and the like which enables a cutter to be usually escaped to a storing position and protruded to a cutting position of packing tape only when a sealing operation is performed, taking safety into consideration.

Another object of the present invention is to provide a sticking apparatus wherein a cutter can be escaped to the storing position until the sealing operation by the packing tape is begun and it can be protruded to the cutting position of the packing tape only when the sealing operation is performed, whereby it is possible for an operator to perform safely the operation without causing any hurt by a cutter blade even if he is careless, in an inspection operation or the like.

In order to achieve the aforementioned objects, according to the present invention, a packing tape sticking apparatus comprises a tape sticking plate which is rotatably supported at a side plate to be urged to a sticking position of the packing tape through a third elastic member, a pressing roller which is rotatably supported at the side plate to be connected to the tape sticking plate through a connection member, and a cutter which is rotatably supported at the side plate and can be urged to a cutting position of the packing tape through a first elastic member arranged between a pressing roller or the tape sticking plate and it and can be urged to a storing position through a second elastic member, wherein, when the tape sticking plate is located in the sticking position of the packing tape through the third elastic member, the cutter is escaped to the storing position by the urging force of the second elastic member which is superior to one of the first elastic member, and when entering a box body makes the tape sticking plate be pushed out against the urging force of the third elastic member, the first elastic member is pulled to make the cutter protrude to the cutting position of the packing tape by the urging force of the first elastic member superior to one of the second elastic member.

In addition, according to the present invention, a packing tape sticking apparatus comprises a tape sticking plate which is rotatably supported at a side plate to be urged to a sticking position of the packing tape through a third elastic member, a pressing roller which is rotatably supported at the side plate to be connected to the tape sticking plate through a connection member, an operation lever which is rotatably supported at the side plate, and a cutter which is rotatably supported at the side plate and can be urged to the cutting position of the packing tape through a first elastic member arranged between the operation lever and it and can be urged to a storing position through a second elastic member, wherein, the cutter is escaped to the storing position by the urging force of the second elastic member which is superior to one of the first elastic member usually arranged between the operation lever and the side plate, and when entering a box body makes the operation lever be pushed out against the urging force of the first elastic member, the urging force of the first elastic member which is superior to one of the second elastic member makes the cutter protrude to the cutting position of the packing tape.

DETAILED DESCRIPTION OF THE PREFERRED EMBODIMENTS

Figure 1:
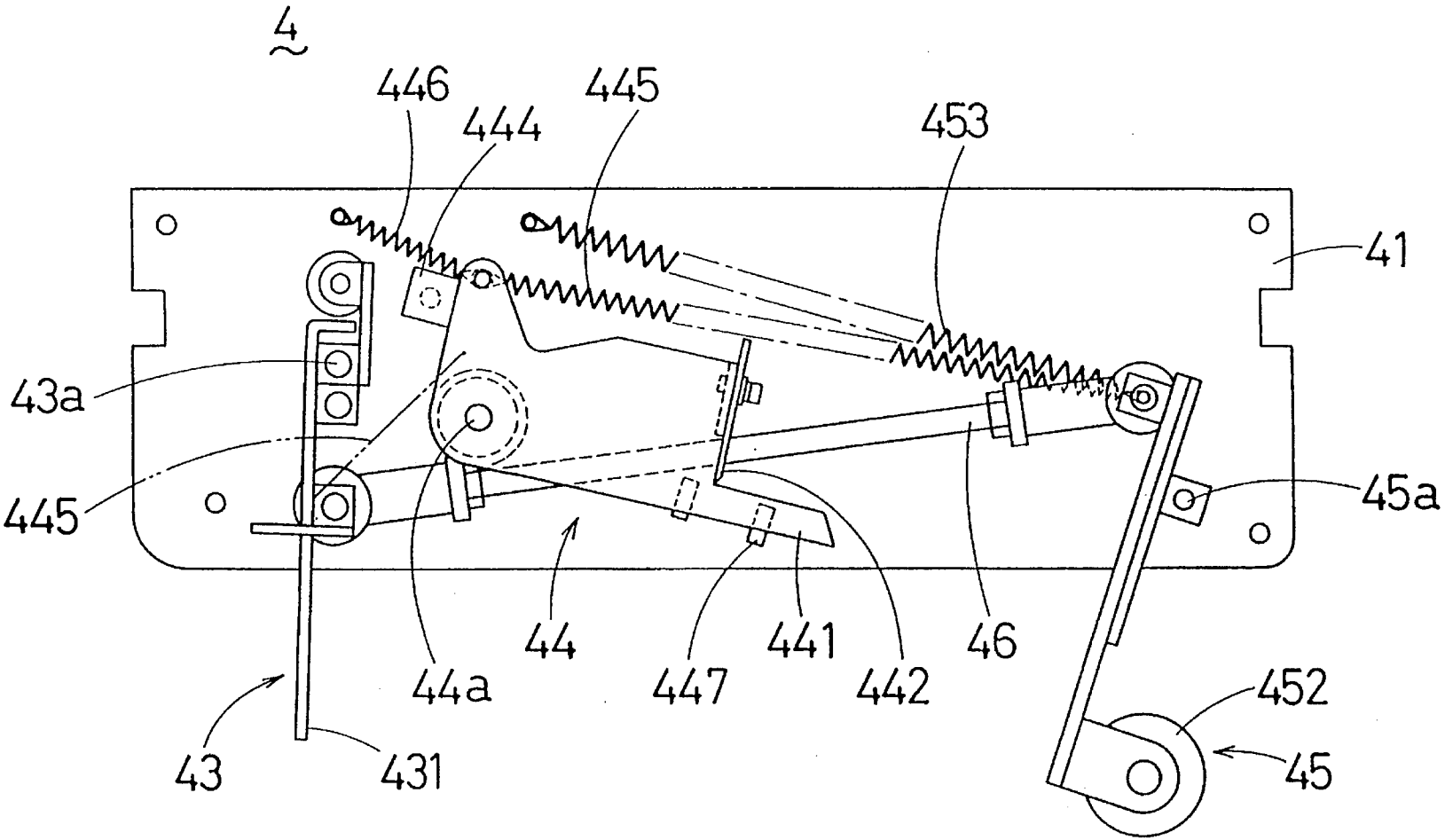
FIG. 1 is a side view exemplarily illustrating a packing tape sticking apparatus according to an example of the present invention.
Figure 2:
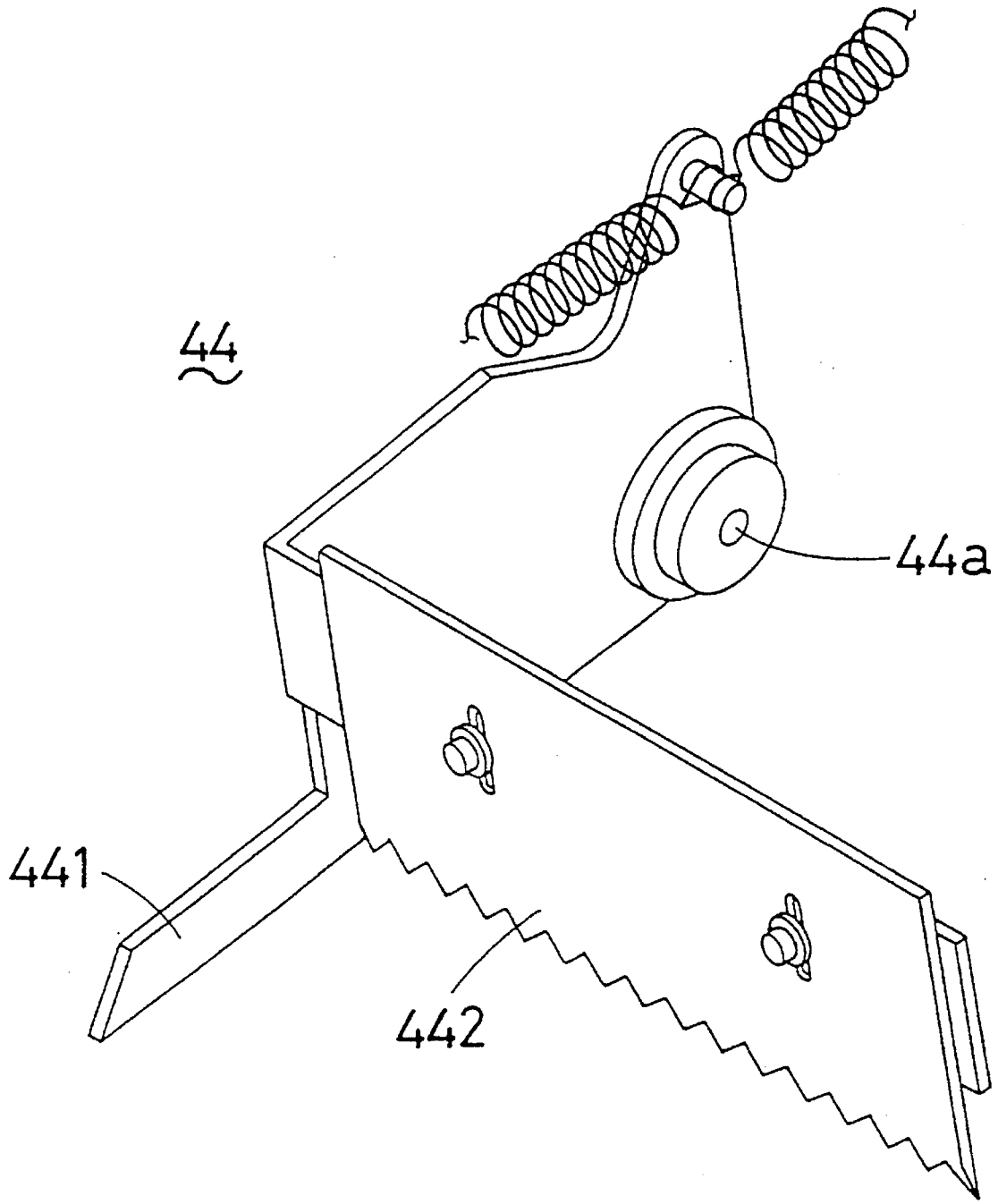
FIG. 2 is a partial-omitted perspective view illustrating a cutter in the sticking apparatus of FIG. 1.

Referring now to the drawings, an embodiment of the invention is described in detail below.

Figure 15:
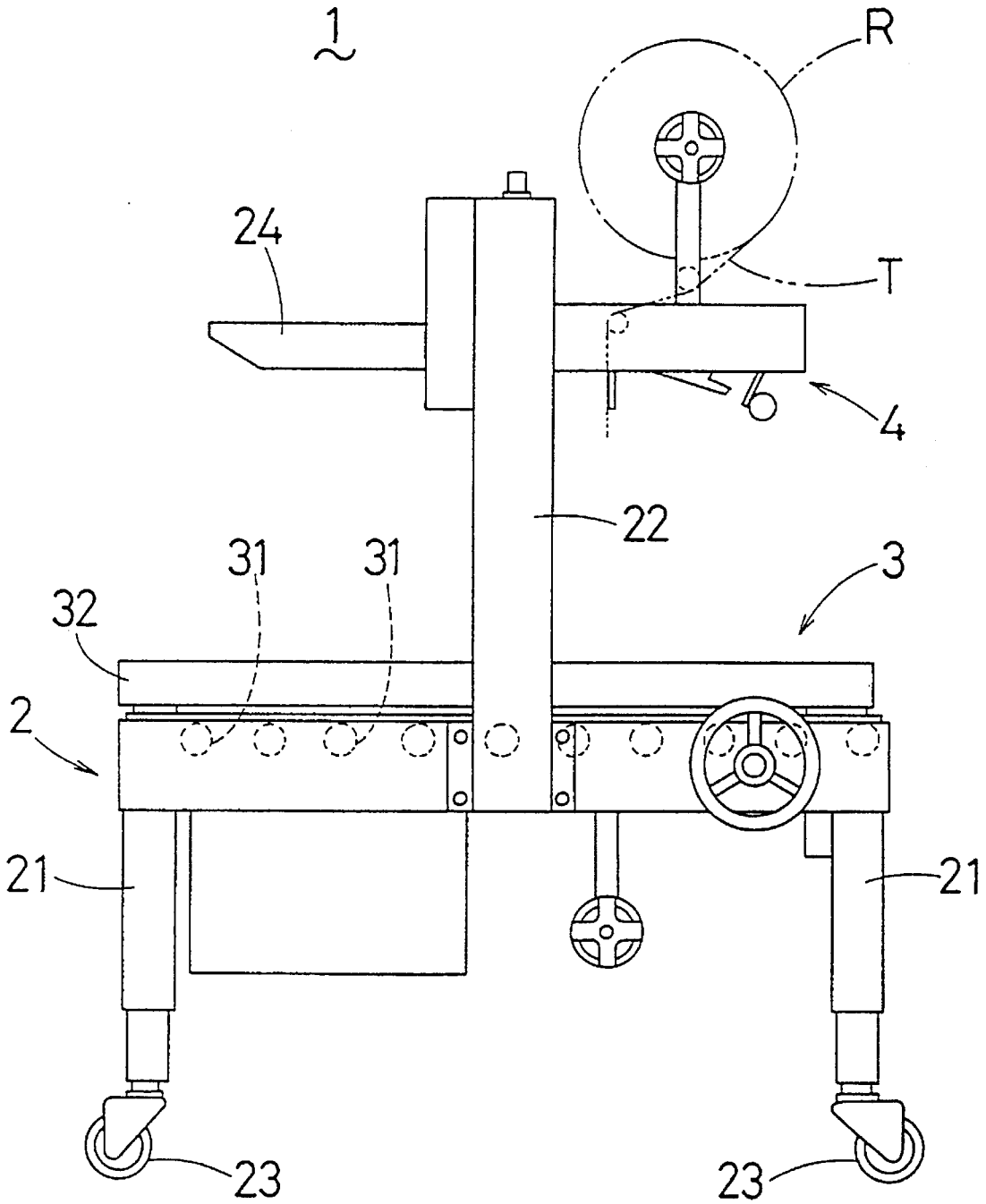
FIG. 15 is a side view illustrating a sealing machine according to the present invention.
Figure 16:
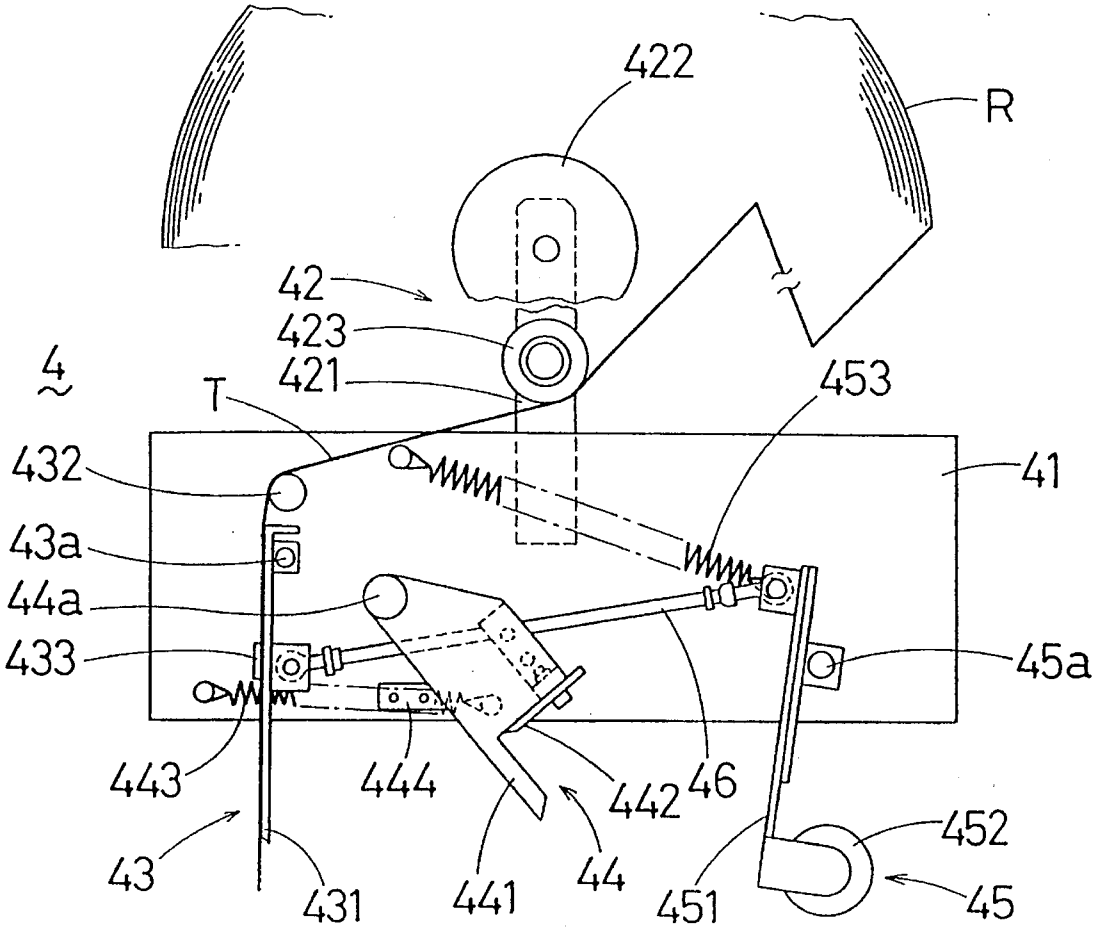
Fig.16 PRIOR ART
FIG. 16 is a side view illustrating a conventional sticking apparatus arranged at the sealing machine of FIG. 15.

For convenience of description, the same members as ones illustrated in FIG. 15 and FIG. 16 are referred to the same numerals and the detail descriptions thereof are omitted.

FIG. 1 shows an example of a sticking apparatus 4 which is included by a sealing machine 1 of a corrugated fibreboard container C. The sticking apparatus 4, in the same way as the conventional sticking apparatus 4 mentioned above, comprises a support arm 42 (not shown), a tape sticking plate 43, a cutter 44, and a pressing roller 45.

At the cutter 44, a spring 445 as a first elastic member which can pull a cutter blade 442 to a cutting position of a packing tape T is connected between the pressing roller 45 and the cutter 44. In case of substituting the above position for one shown by double chain lines in FIG. 1, the spring 445 may be connected between the tape sticking plate 43 and the cutter 44, and a spring 446 as a second elastic member which can pull the cutter blade 442 to a storing position is connected between side plate 41 and the cutter 44. The spring force of the first spring 445 is set more strongly than one of the second spring 446. Moreover, the first spring 445 does not generate the pulling force under a natural condition which is not elastically transformed, when the tape sticking plate 43 is located in a sticking position of the packing tape T by the pulling force of a spring 453 as a third elastic member, whereby the cutter 44 is pulled to the position wherein a cutter cam 441 is met with a stopper 444 by the pulling force of the second spring 446, in other words, the storing position wherein the cutter blade 442 is escaped to an inside of the sticking apparatus 4. On the other hand, when the tape sticking plate 43 is rotated by entering the corrugated fibreboard container C against the pulling force of the third spring 453, the first spring 445 is pulled against the pulling force of the second spring 446, thereby generating the pulling force and making the cutter 44 protrude to the cutting position of the packing tape T.

When the aforementioned cutter 44 is escaped to the storing position, a U-shaped guard 447 by which the rotating locus of the cutter blade 442 is held so as to face the front in rotating direction thereof is arranged at a side plate 41. As a result, even if an operator inserts his hand in an inner space divided by the side plates 41, 41, the guard 447 prevents him from touching the edge of the cutter blade 442.

Figure 3:
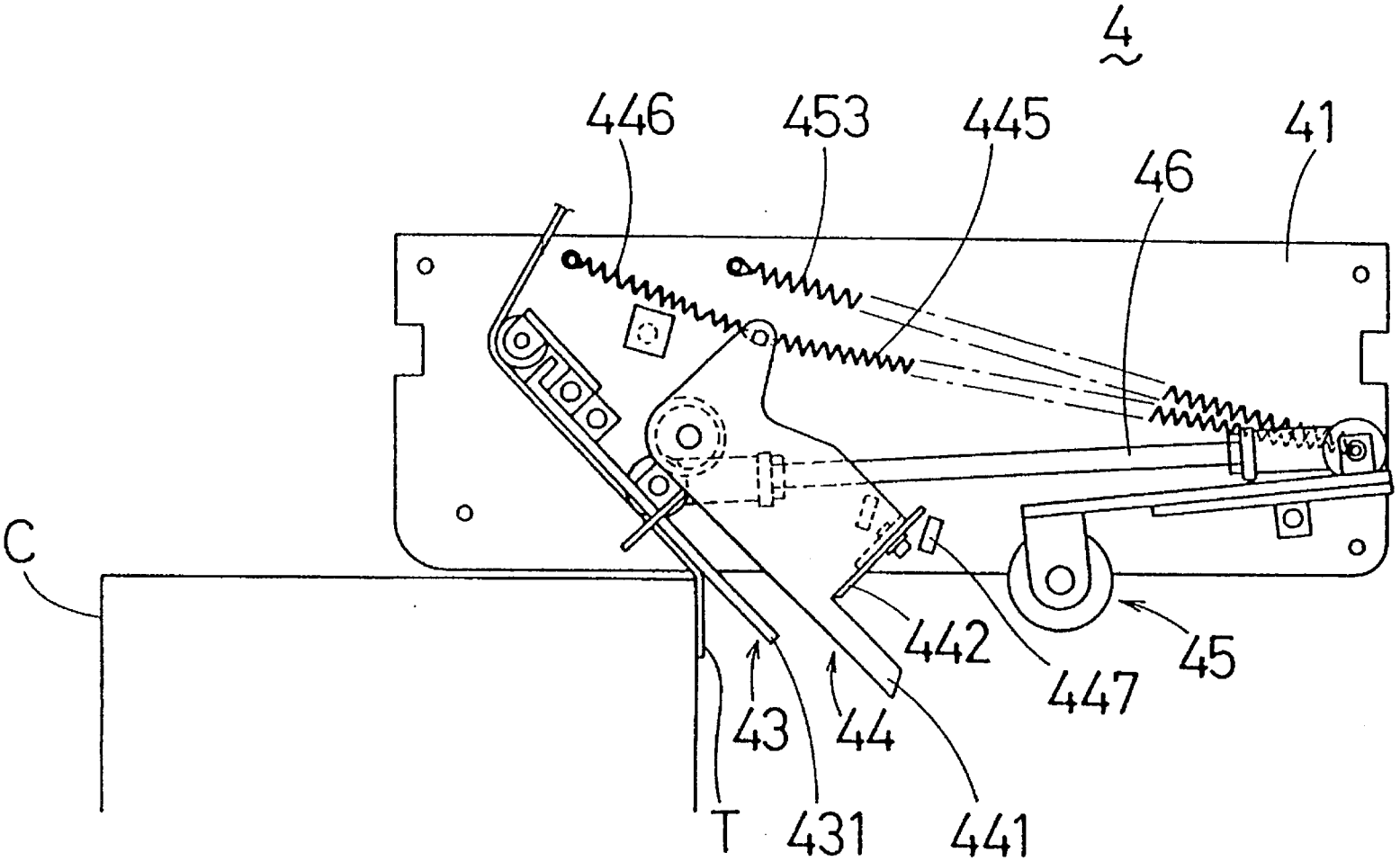
FIG. 3 is a descriptive view of a sealing process of a box body according to the sticking apparatus of FIG. 1.

On the other hand, when the corrugated fibreboard container C is entered, as mentioned above, the front face thereof is met with a sticking plate body 431 of the tape sticking plate 43 and the packing tape T hung along the surface thereof is stuck, at the same time while the sticking plate body 431 is rotated downstream to be pushed upward. The rotation of the sticking plate 43 makes the pressing roller 45 rotate upstream through a connection rod 46 at the same time while the first spring 445 is pulled, thereby making the cutter 44 rotate against the pulling force of the second spring 446. Therefore, the cutter blade 442 passes through the guard 447 to protrude to the cutting position of the packing tape T. (See FIG. 3.)

Figure 4:
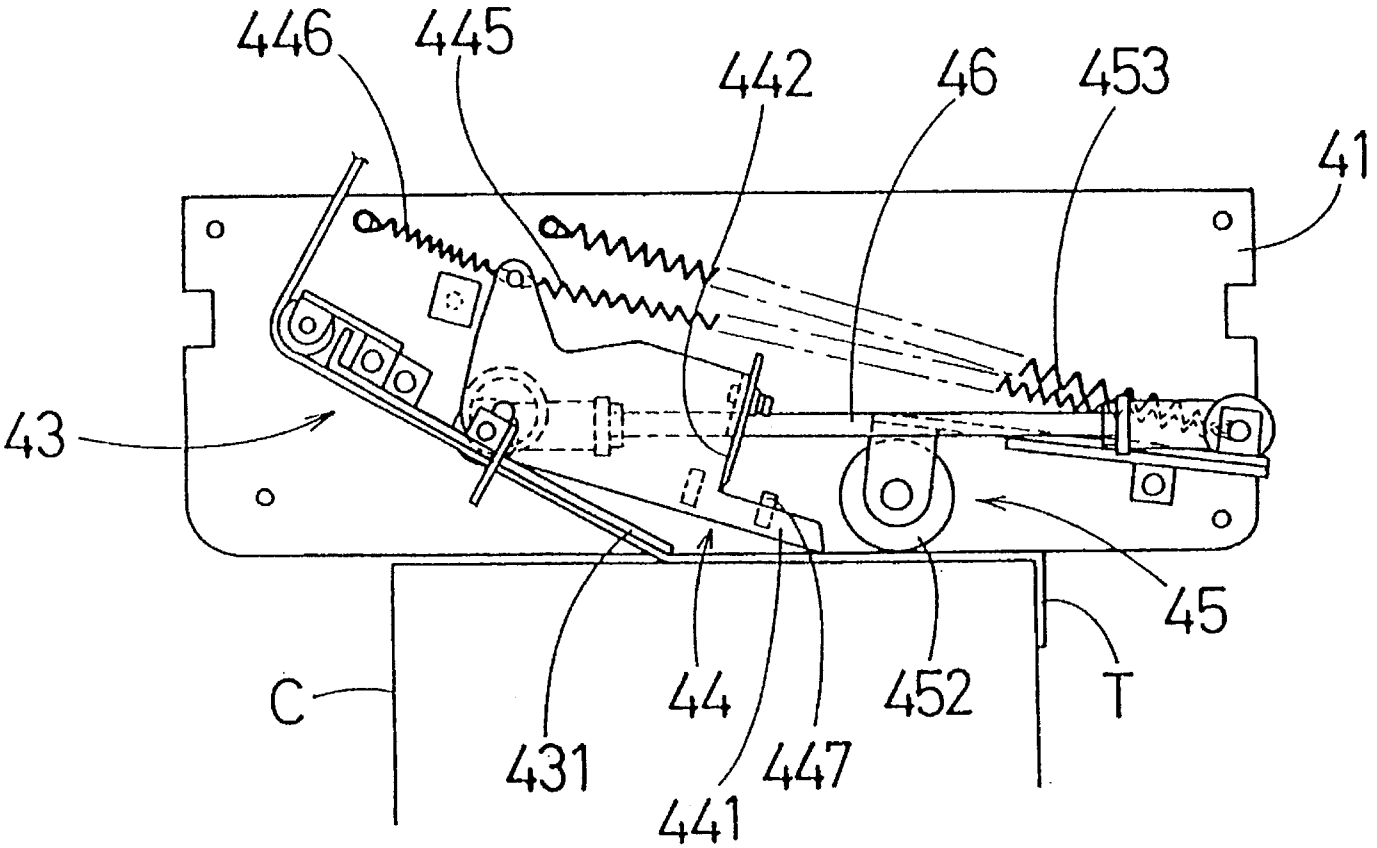
FIG. 4 is a descriptive view of a sealing process of a box body according to the sticking apparatus of FIG. 1.

Moreover, when the corrugated fibreboard container C is carried downstream, a packing tape roll R rotates, thereby drawing the packing tape T. On the other hand, the front face of the corrugated fibreboard container C is met with the cutter cam 441 of the cutter 44, thereby making the cutter cam 441 rotate downstream against the pulling force of the first spring 445 to be pushed upward. Therefore, the cutter blade 442 is escaped upward so as not to touch the packing tape T. On the other hand, the rotation of the tape sticking plate 43 makes the pressing roller 45 be pushed upstream through the connection rod 46 against the pulling force of the third spring 453 with the result that the packing tape T stuck to the butt portions of the outside flaps F2 of the corrugated fibreboard container C is pressed by a roller 452 by means of the pulling force of the third spring 453 to stick the packing tape T while rotating in pursuit of the carriage of the corrugated fibreboard container C. (See FIG. 4).

Figure 5:
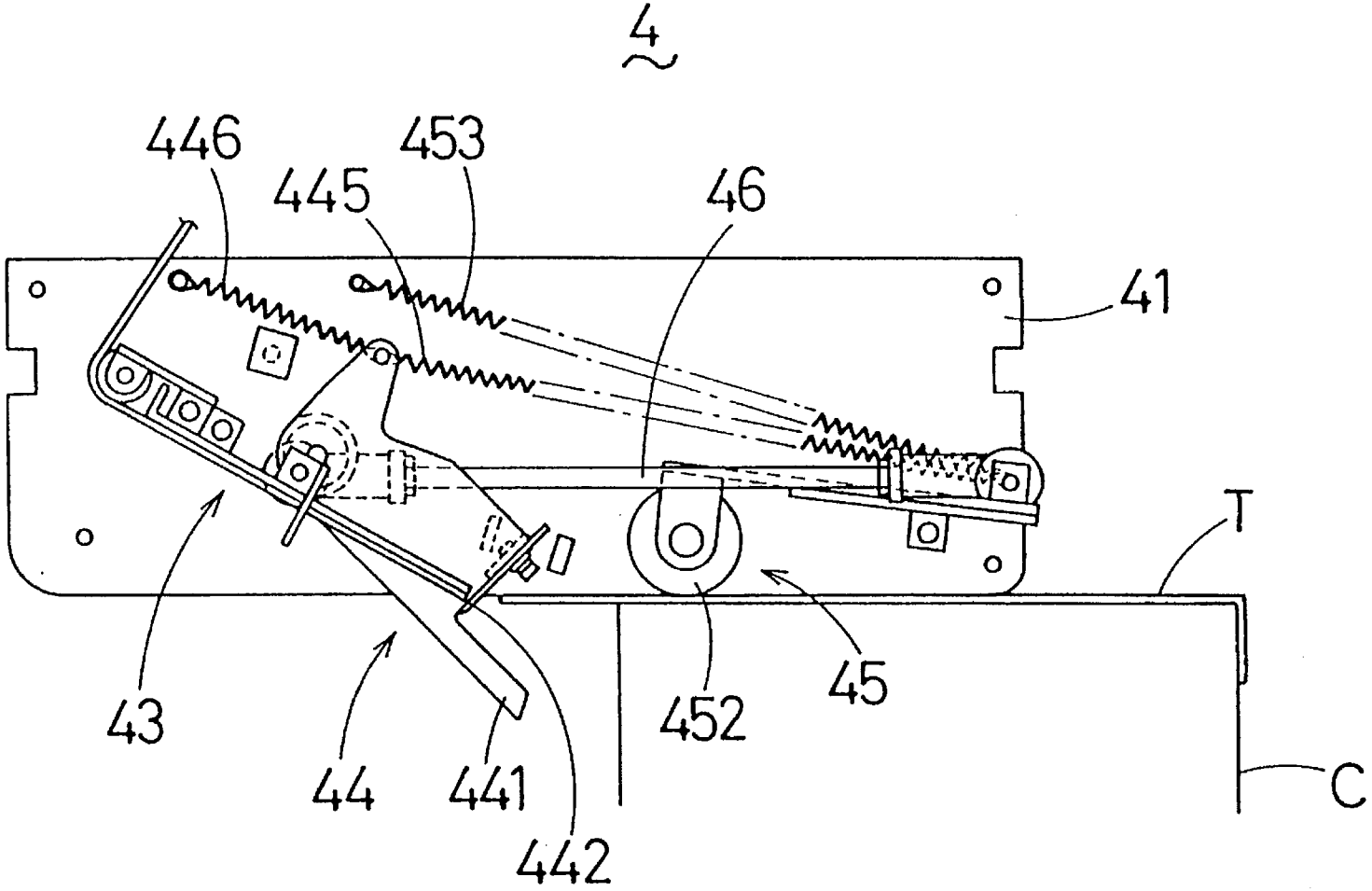
FIG. 5 is a descriptive view of a sealing process of a box body according to the sticking apparatus of FIG. 1.

The corrugated fibreboard container C is carried, thereby making the sticking operation of the packing tape T continue. Even if the back end of the corrugated fibreboard container C passes through the tape sticking plate 43, the pressing roller 45 contacts the upper surface of the corrugated fibreboard container C with the result that the tape sticking plate 43 is located in the position wherein it is kept pushed up. Furthermore, when the corrugated fibreboard container C is carried, and the back end thereof is removed from the edge of the cutter cam 441, the cutter cam 441 is rotated upstream by the pulling force of the first spring 445, whereby the cutter blade 442 cuts the packing tape T. (See FIG. 5).

Figure 6:
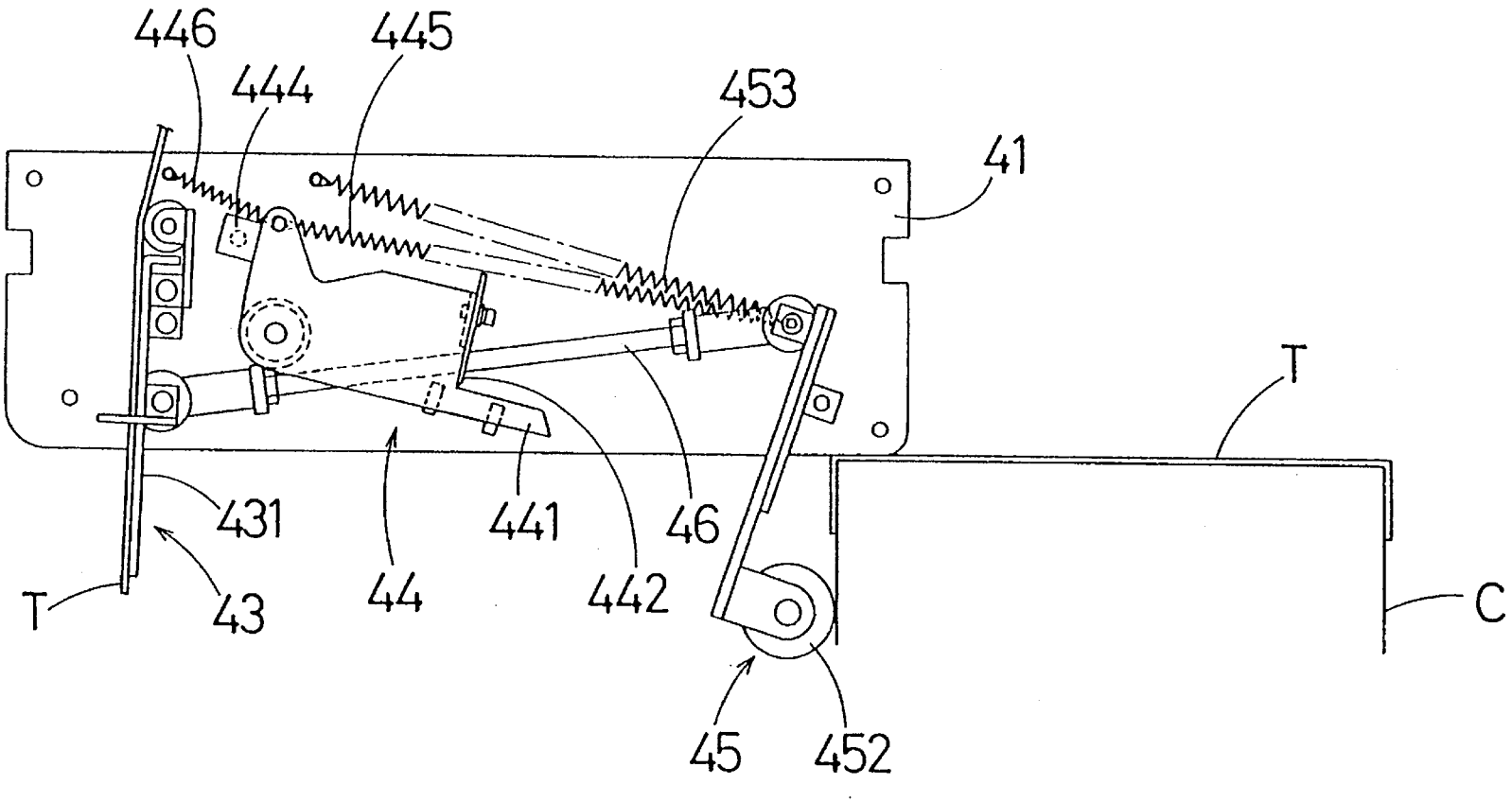
FIG. 6 is a descriptive view of a sealing process of a box body according to the sticking apparatus of FIG. 1.

After the packing tape T is cut, the corrugated fibreboard container C is further carried and the back end thereof is removed from the roller 452 with the result that the roller 452 is rotated downstream by the pulling force of the third spring 453, thereby pressing the end of the packing tape T to the back face of the corrugated fibreboard container C for sticking. On the other hand, when the rotation of the pressing roller 45 makes the tape sticking plate 43 be pushed out through the connection rod 46 so as to return to the sticking position, the first spring 445 resumes a natural condition which does not lead to an elastic transformation with the result that the cutter 44 is escaped to the storing position wherein the cutter 44 is met with a stopper 444 by the pulling force of the second spring 446. Moreover, the cut packing tape T is hung while the edge thereof goes over the lower end of the sticking plate body 431, so as to be prepared for entering the next corrugated fibreboard container C. (See FIG. 6).

As mentioned above, at a pre-stage of the sealing operation by means of the packing tape T, the cutter 44 is escaped to the storing position by means of the pulling force of the second spring 446. When the box body such as the corrugated fibreboard container C or the like is entered to begin the sealing operation, the tape sticking plate 43 is rotated, thereby making the first spring 445 be pulled against the pulling force of the second spring 446, and the cutter 44 is protruded to the cutting position of the packing tape T, whereby the cutter 44 is not protruded to the cutting position in an inspection operation or the like with the result that it is possible for an operator to perform safely the operation without causing any hurt by the cutter blade 442 even if he is careless.

Moreover, the guard 447 by which the rotating locus of the cutter blade 442 at the storing position is held so as to face forward in a rotating direction thereof is arranged with the result that, even if a hand is inserted in an inside of the sticking apparatus 4, except inserting consciously fingers, there is no contact with the cutter blade 442 to be much safer.

By the way, the above mentioned example has a structure wherein the cutter 44 is pulled to the cutting position of the packing tape T through the first spring 445 arranged between the pressing roller 45 and the cutter 44, and pulled to the storing position through the second spring 446. However, the first spring 445 may be connected to other member arranged except the pressing roller 45 or the tape sticking plate 43 to urge the cutter 44 to the cutting position of the packing tape T.

Hereinafter, FIG. 7 to FIG. 11 show another example including an operation lever 47 which pulls the first spring 445 to the cutting position of the packing tape T.

Figure 7:
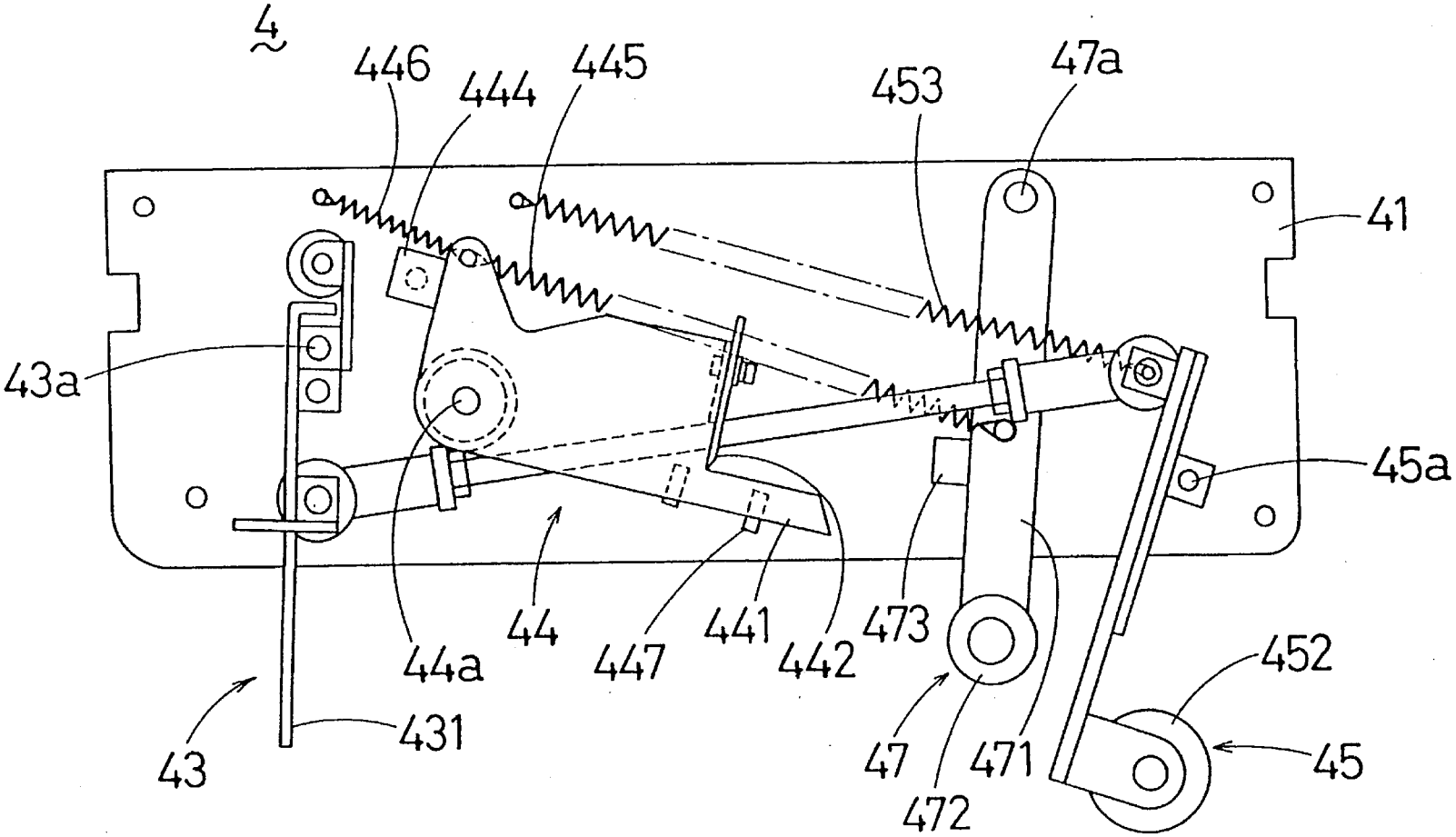
FIG. 7 is a side view exemplarily illustrating a packing tape sticking apparatus according to another example of the present invention.
Figure 8:
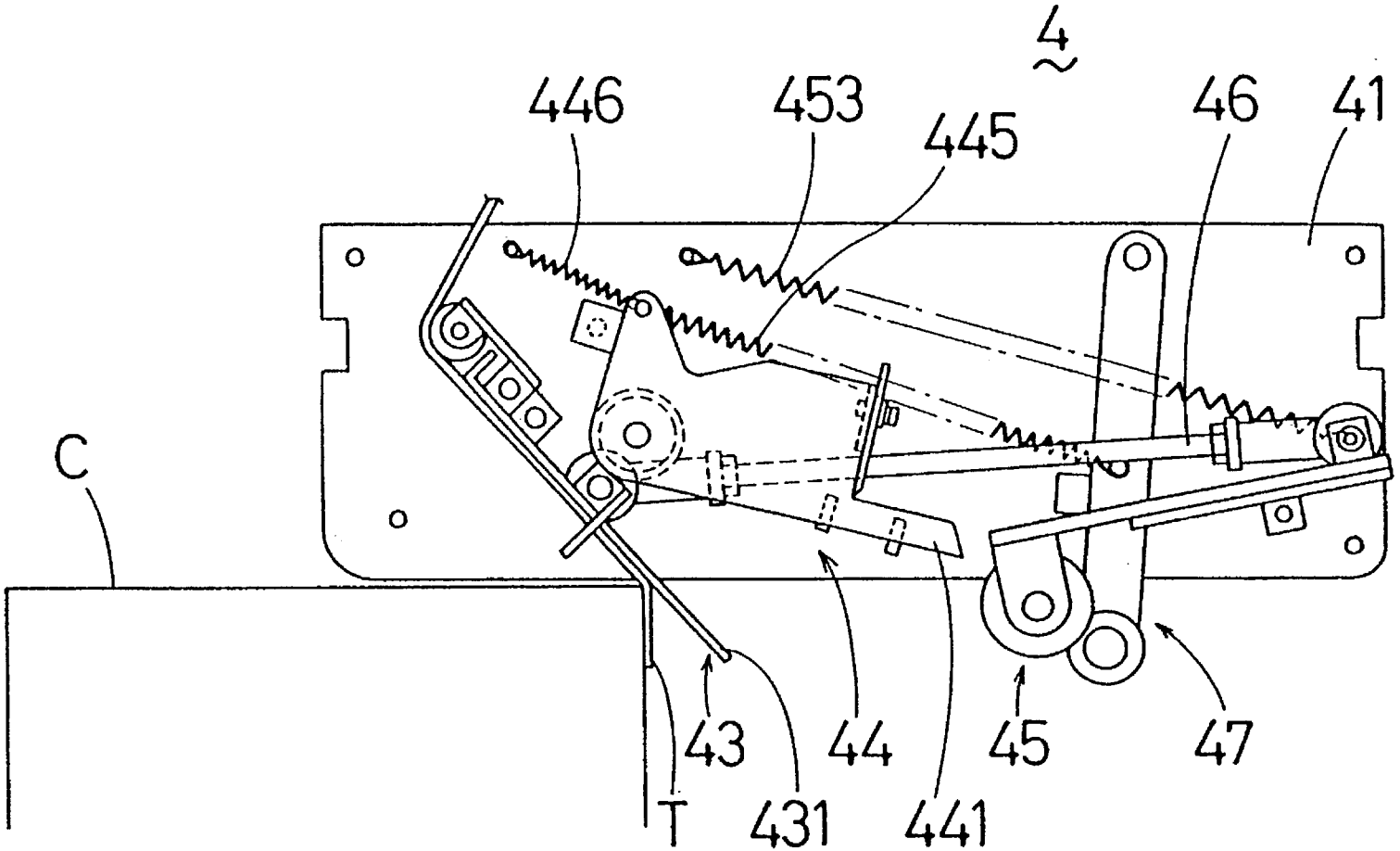
FIG. 8 is a descriptive view of a sealing process of a box body according to the sticking apparatus of FIG. 7.
Figure 9:
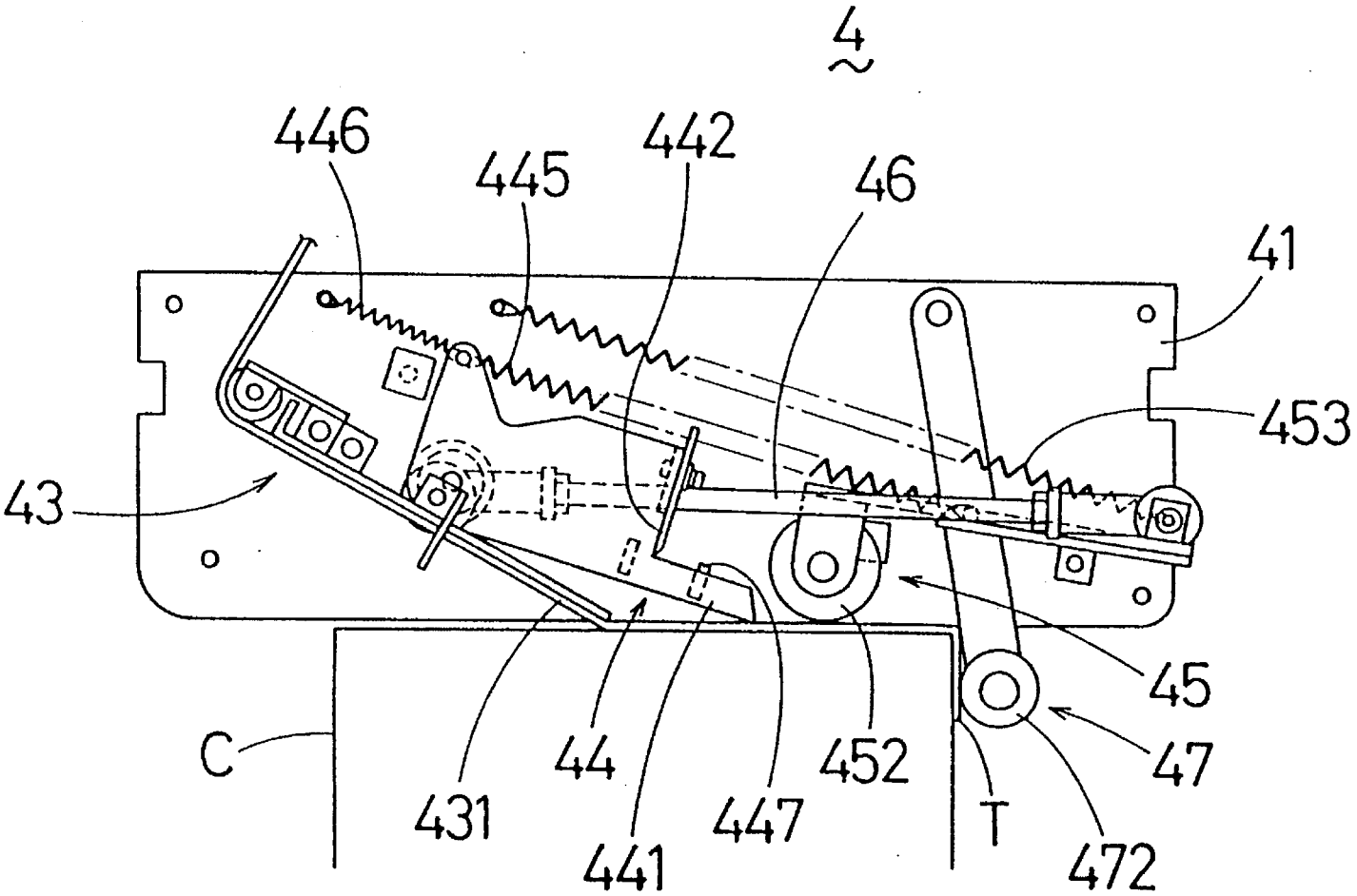
FIG. 9 is a descriptive view of a sealing process of a box body according to the sticking apparatus of FIG. 7.
Figure 10:
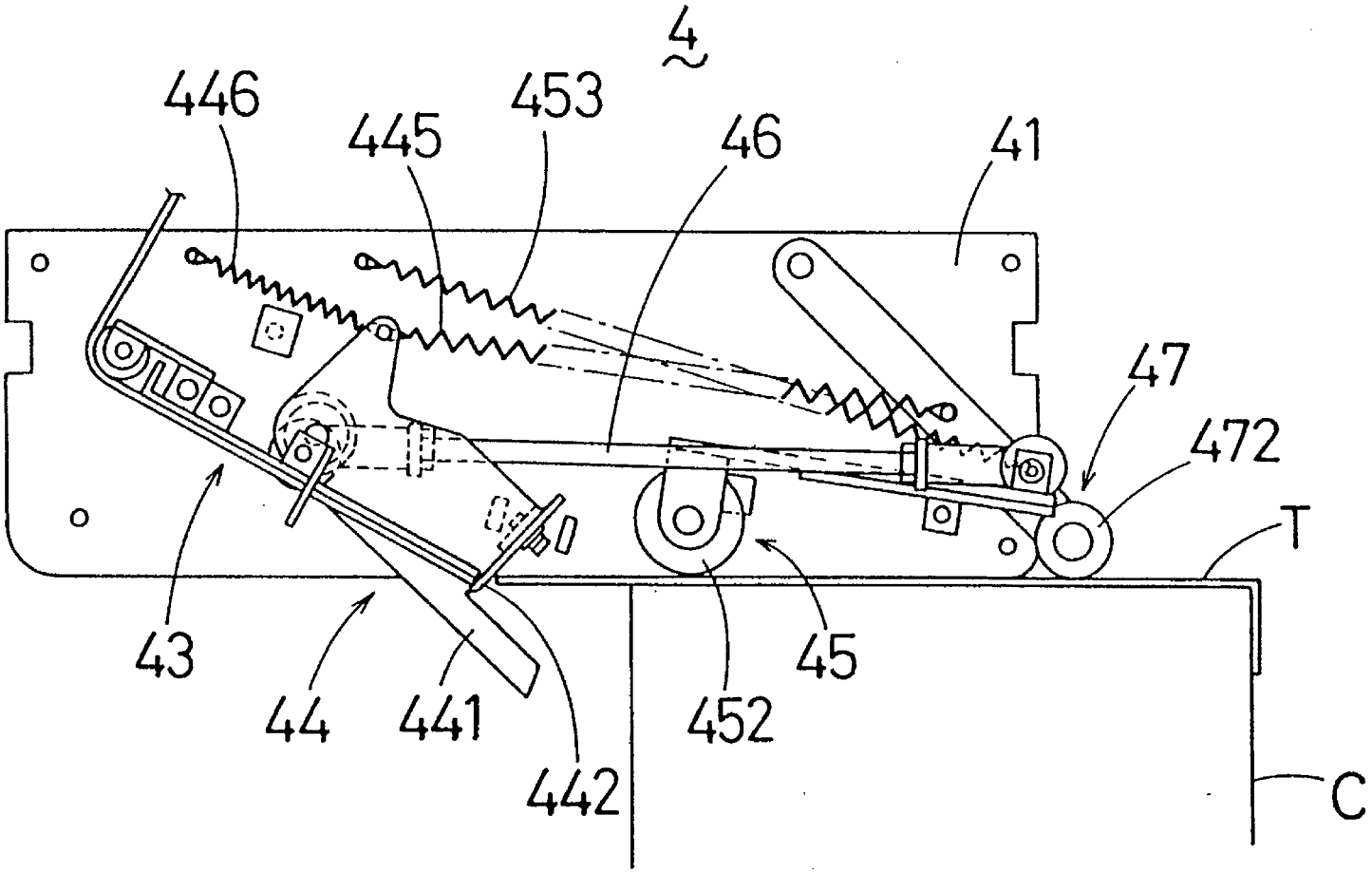
FIG. 10 is a descriptive view of a sealing process of a box body according to the sticking apparatus of FIG. 7.
Figure 11:
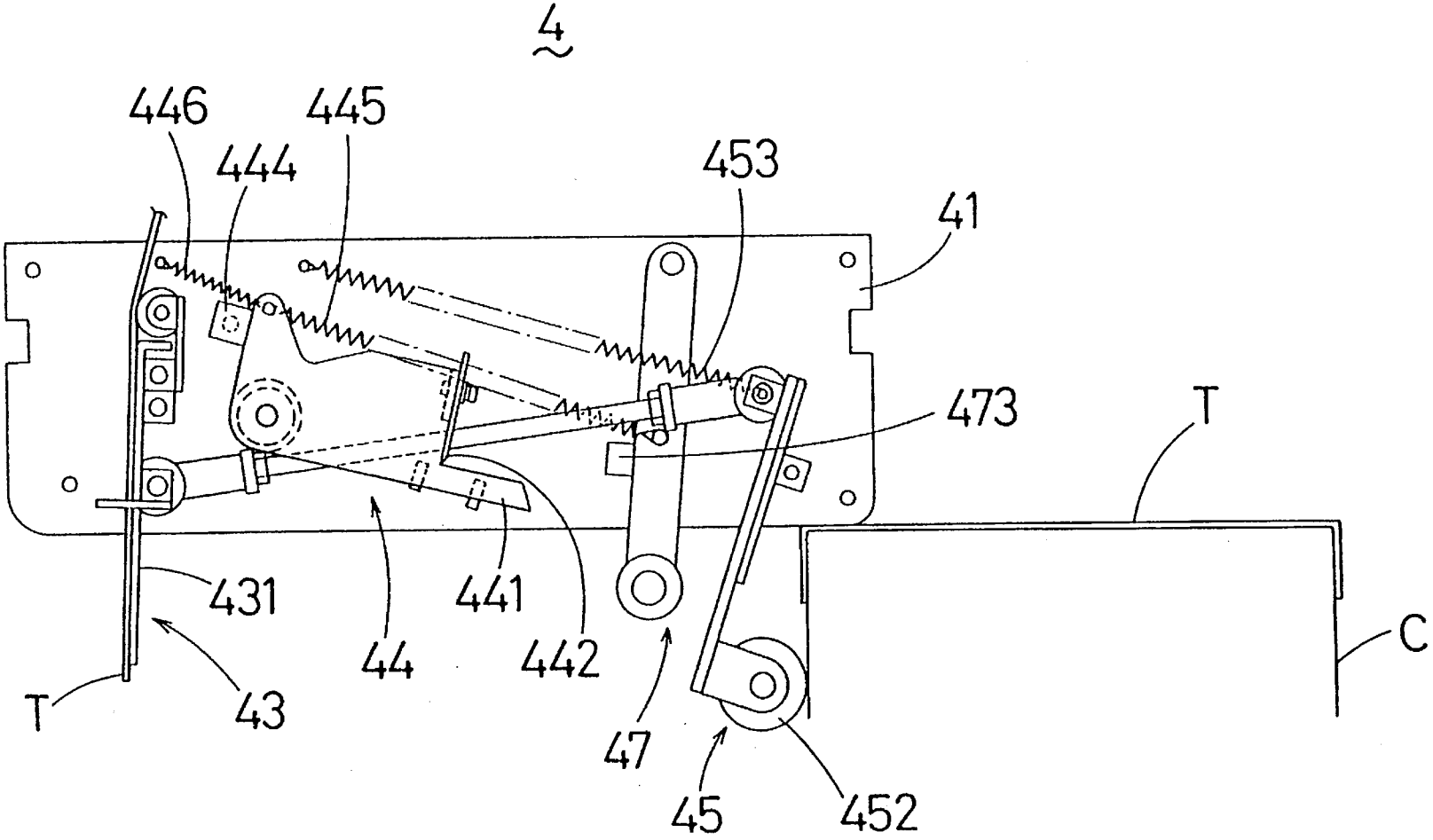
FIG. 11 is a descriptive view of a sealing process of a box body according to the sticking apparatus of FIG. 7.

The operation lever 47 in this example, as shown FIG. 7, comprises a lever body 471 which is rotatably supported at surroundings of a pin 47*a* arranged at a side plate 41, and a roller 472 which is rotatably arranged at the lever body 471, wherein the first spring 445 is arranged between the operation lever 47 and the cutter 44. Therefore, the operation lever 47 is pulled to the suspended position wherein it is met with a stopper 473 which is usually arranged at a side plate 41 by the pulling force of the first spring 445. On the other hand, in the same way as the above mentioned example, the spring force of the first spring 445 is set more strongly than one of the second spring 446. Therefore, when the corrugated fibreboard container C is not entered, and the operation lever body 471 is located in the suspended position wherein it is met with the stopper 473, the first spring 445 does not generate the pulling force under a natural condition wherein an elastic transformation is not caused with the result that the cutter 44 is pulled to the storing position wherein the cutter blade 442 escapes to the inside of the sticking apparatus 4 after the cutter cam 441 is met with the stopper 444 by the pulling force of the second spring 446. If the operation lever body 471 is pushed downstream by entering the corrugated fibreboard container C, the first spring 445 is pulled against the pulling force of the second spring 446, thereby generating the pulling force to protrude the cutter 44 to the cutting position of the packing tape T.

Figure 12:
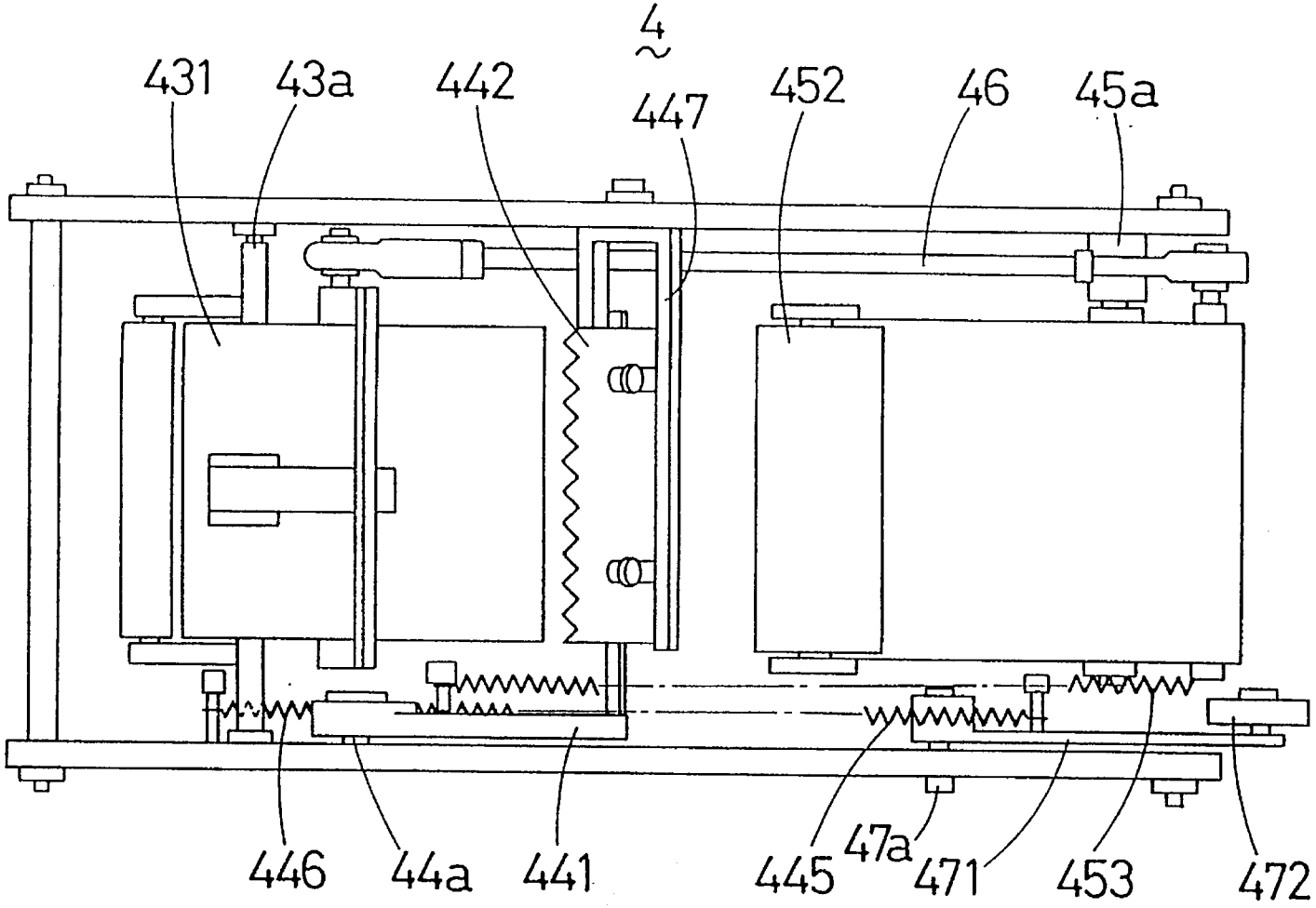
FIG. 12 is a bottom view of a sticking apparatus in the sealing process in FIG. 10.

As the details are shown in FIG. 12, the operation lever 47 is rotatably supported at a side plate 41 and the pressing roller 45 is rotatably supported at other side plate 41, in each state of one side support, whereby, when the operation lever 47 and the pressing roller 45 rotate by means of entering the corrugated fibreboard container C, the interference with both of them is prevented.

When the corrugated fibreboard container C is entered, as mentioned above, the front face thereof is met with the sticking plate body 431 of the tape sticking plate 43 to stick the packing tape T at the same time while the sticking plate body 431 is pushed upward. The rotation of the tape sticking plate 43 makes the pressing roller 45 rotate upstream through the connection rod 46. Under this condition, the operation lever 47 is located in the suspended position and the cutter 44 is pulled to the storing position by the pulling force of the second spring 446. (See FIG. 8.)

Moreover, when the corrugated fibreboard container C is carried backward, the packing tape roll R rotates to draw the packing tape T while sealing the butt portions of the outside flaps F2 by the packing tape T, at the same time when the pressing roller 45 pushed up through the connection rod 46 presses the packing tape T to be stuck with rotating in pursuit of the carriage of the corrugated fibreboard container C. (See FIG. 9.)

When the corrugated fibreboard container C is further entered, it is met with the operation lever 47 to push up the operation lever 47 downstream with the result that the first spring 445 is pulled and the pulling force of the first spring 445 which is stronger than one of the second spring 446 makes the cutter 44 rotate to the cutting position of the packing tape T. At that time, the cutter cam 441 of the cutter 44 is contacted on the surface of the corrugated fibreboard container C, whereby the cutter blade 442 is not contacted with the packing tape T.

Furthermore, even if the sticking operation of the packing tape T is continued by the carriage of the corrugated fibreboard container C, and the back end of the corrugated fibreboard container C passes through the tape sticking plate 43, the pressing roller 45 and the operation lever 47 contact on the surface of the corrugated fibreboard container C, whereby the tape sticking plate 43 is located in the position to remain pushed up and the cutter cam 441 of the cutter 44 is in the position to contact on the surface of the corrugated fibreboard container C. When the back end of the corrugated fibreboard container C is removed from the edge of the cutter cam 441, the cutter cam 441 is rotated to a upper side by the pulling force of the first spring 445 with the result that the cutter blade 442 cuts the packing tape T. (See FIG. 10.)

After the packing tape T is cut, the corrugated fibreboard container C is further carried, the back end of the corrugated fibreboard container C is removed from the roller 452. At that time, the roller 452 is rotated by the third spring 453 to press the end portion of the packing tape T to the back face of the corrugated fibreboard container C, thereby sticking it and the tape sticking plate 43 is pushed out through the connection rod 46 so as to rotate to the sticking position. In addition, the cut packing tape T is hung while the edge thereof goes over the lower end of the sticking plate body 431, so as to be prepared for entering the next corrugated fibreboard container C. Furthermore, when the back end of the corrugated fibreboard container C passes through the operation lever 47, the operation lever 47 returns to the suspended position wherein it is met with the stopper 473 by the pulling force of the first spring 445. As a result, the first spring 445 returns to a natural condition which is not elastically transformed. Therefore, the cutter 44 escapes upward from the cutting position to the storing position to meet with the stopper 444 owing to the pulling force of the second spring 446 which is stronger than one of the first spring 445. (See FIG. 11.)

Thus, at a pre-stage of the sealing operation by means of the packing tape, the cutter 44 is escaped to the storing position by the pulling force of the second spring 446. When the box body such as the corrugated fibreboard container C or the like is entered to begin the sealing operation and the operation lever 47 is also pushed, the rotation of the operation lever 47 makes the first spring 445 be pulled against the pulling force of the second spring 446 to protrude the cutter 44 to the cutting position of the packing tape T, whereby the cutter 44 is not protruded to the cutting position in an inspection operation or the like with the result that it is possible for an operator to perform safely the operation without causing any hurt by the cutter blade 442 even if he is careless.

In addition, as shown in the aforementioned example, the guard 447 are arranged with the result that, even if a hand is inserted in the inside of the sticking apparatus 4, except inserting consciously fingers, it is possible to prevent surely the fingers from touching the cutter blade 442.

In this example, only in the case that the operation lever 47 is pushed upward by entering the corrugated fibreboard container C, the cutter 44 is pulled to the cutting position of the packing tape T, thereby including the operation lever 47 close to the cutter 44, which enables a state be shorter that the cutter 44 is located in the cutting position than one in the described above example, leading to being much safer.

As shown in FIG. 12, the operation lever 47 in this example is preferred to be rotatably supported at the inside of the sticking apparatus 4. However, if a space enough to allow the operation lever 47 to rotate can not be ensured, it may be rotatably supported so as to rotate in the outside of the side plate 41. In this case, the pin **47*a* of the operation lever 47 may be protruded to the inside of the side plate 41 and the first spring 445 may be arranged between the side plate 41 and an arm arranged at the pin 47*a***.

Although these examples are described about the sealing machine which seals the butt portions of the outside flaps F2 of the top surface side of the corrugated fibreboard container C packed with the products by the packing tape T, they enable not only the butt portions of the outside flaps F2 of the top surface side of the corrugated fibreboard container C but also ones of the outside flaps F2 of the bottom surface side thereof to be jointed and sealed by the packing tape T. In this case, the sticking apparatus 4 may be arranged at the base 2 so as to be symmetrical to the sticking apparatus 4 arranged at the planer-type frame 22 in upper and lower sides.

Figure 13A:
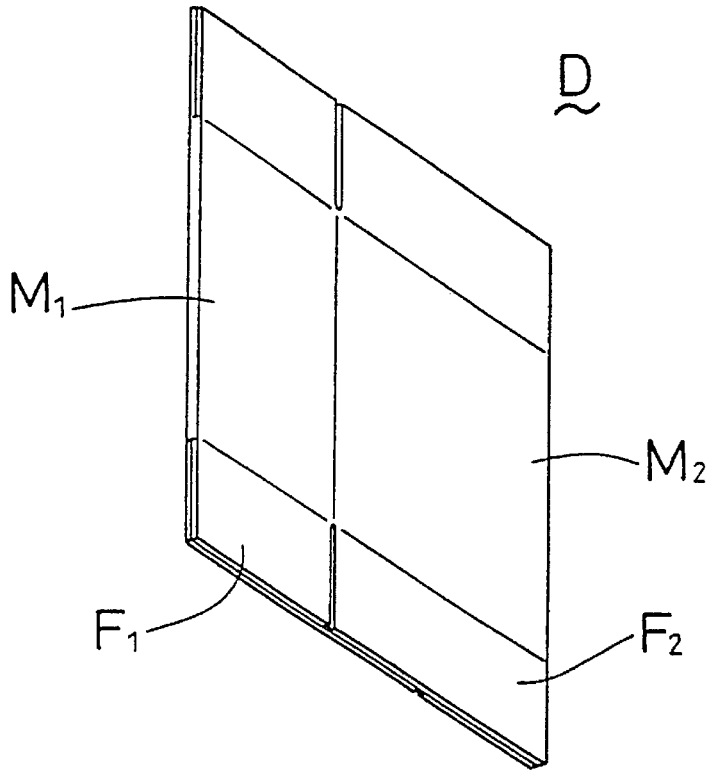
FIG. 13 is a descriptive view illustrating an outline for constructing a box of a corrugated fibreboard for case according to the present invention.
Figure 13B:
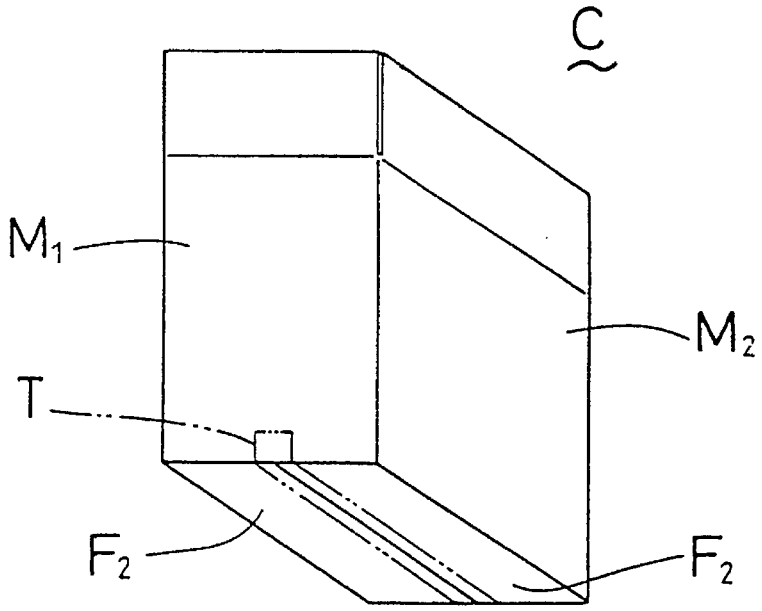
Figure 14:
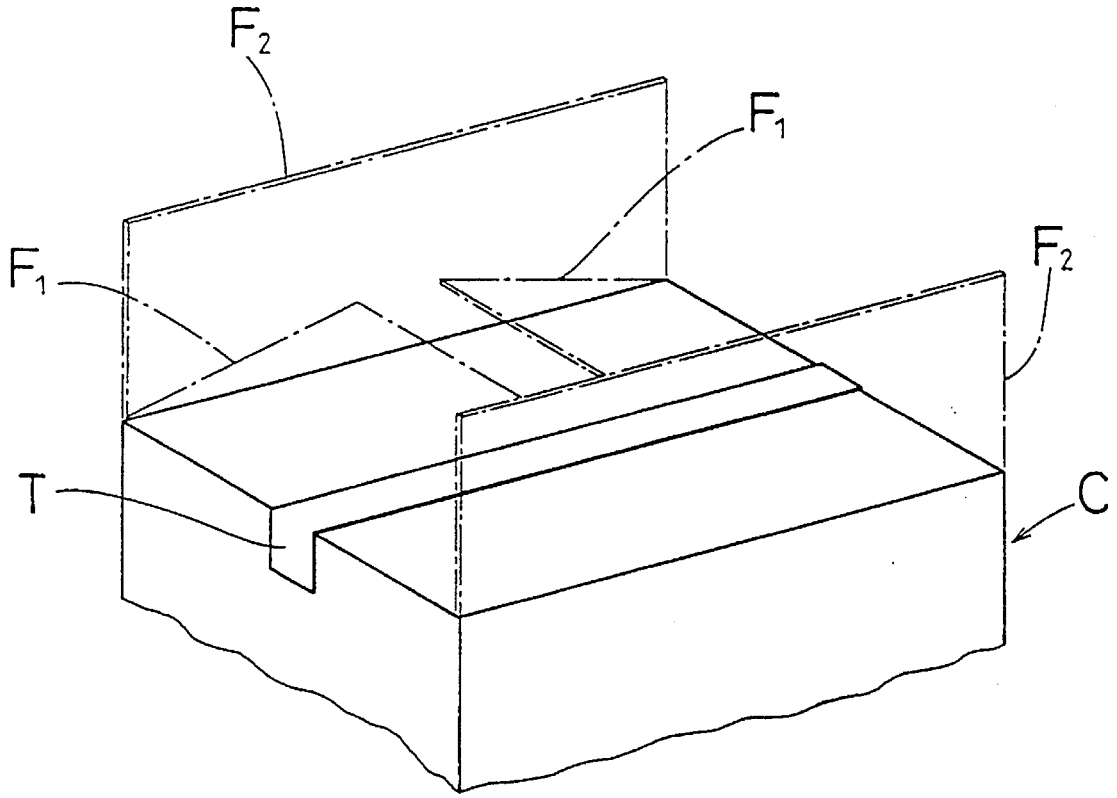
FIG. 14 is a descriptive view illustrating an outline for sealing a box body according to the present invention.

Moreover, the above examples are described about the sealing machine 1, wherein the products are packed in the corrugated fibreboard container C which is constructed in advance before the butt portions of the outside flaps F2 thereof are sealed by the packing tape T. As shown in FIG. 13, it may be applied to a box construction machine wherein a corrugated fibreboard for case D is opened and the inside flaps F1 which are respectively connected to the lower edges of the front and back faces thereof M1 and the outside flaps F2 which are respectively connected to the lower edges of the right and left faces thereof M2 are subsequently folded before the butt portions of the outside flaps F2 thereof are sealed by the packing tape T to be constructed.

Although the spring as the elastic member is illustrated in the above examples, a rubber may be used.

As is described above, according to the present invention, the packing tape sticking apparatus comprises a tape sticking plate which is rotatably supported at a side plate to be urged to the sticking position of the packing tape through a third elastic member, a pressing roller which is rotatably supported at the side plate to be connected to the tape sticking plate through a connection member, and a cutter which is rotatably supported at the side plate and can be urged to a cutting position of the packing tape through a first elastic member arranged between the pressing roller or the tape sticking plate and the cutter and can be urged to the storing position through a second elastic member, wherein, when the tape sticking plate is located in the sticking position of the packing tape through the third elastic member, the cutter is escaped to the storing position by the pulling force of the second elastic member which is superior to one of the first elastic member, and when entering a box body makes the tape sticking plate be pushed out against the pulling force of the third elastic member, the first elastic member is pulled to make the cutter protrude to the cutting position of the packing tape by the pulling force of the first elastic member superior to one of the second elastic member, whereby the cutter can be escaped to the storing position until a sealing operation by the packing tape is begun and it can be protruded to the cutting position of the packing tape only when the sealing operation is performed with the result that it is possible for an operator to perform safely an operation without causing any hurt by the cutter blade even if he is careless in the inspection operation or the like.

In addition, the packing tape sticking apparatus comprises a tape sticking plate which is rotatably supported at a side plate to be urged to a sticking position of the packing tape through a third elastic member, a pressing roller which is rotatably supported at the side plate to be connected to the tape sticking plate through a connection member, an operation lever which is rotatably supported at the side plate, and a cutter which is rotatably supported at the side plate and can be urged to the cutting position of the packing tape through a first elastic member arranged between the operation lever and the cutter and can be urged to the storing position through a second elastic member, wherein the cutter is escaped to the storing position by the urging force of the second elastic member which is superior to one of the first elastic member usually arranged between the operation lever and the side plate, and when entering a box body makes the operation lever be pushed out against the urging force of the first elastic member, the urging force of the first elastic member which is superior to one of the second elastic member makes the cutter protrude to the cutting position of the packing tape, whereby the cutter can be escaped to the storing position until a sealing operation by the packing tape is begun and it can be protruded to the cutting position of the packing tape only when the sealing operation is begun to make the operation lever be pushed by the box body with the result that it is possible for an operator to perform safely an operation without causing any hurt by the cutter blade even if he is careless in the inspection operation or the like.

What is claimed is:

1. A packing tape sticking apparatus wherein, in order to seal butt portions of a pair of closed flaps of a carried box body, an adhesive tape for packing which is drawn from a roll according to a progress of the box body is stuck to the butt portions thereof so as to cut the tape after the tape is stuck in a fixed length, comprising a pair of side plates, a tape sticking plate which is rotatably arranged between the side plates and located at one end of the plates so as to stick an end portion of the tape to a front face of the carried box body, a tape pressing member which is rotatably arranged between the side plates and located at the other end of the plates so as to press the tape stuck to the box body according to the progress of the box body, a cutter which is arranged between the tape sticking plate and the tape pressing member so as to rotate between a storing position between the side plates and a cutting position protruded from the side plates, thereby cutting the tape in a state of having a length left backward in the butt portions when it is rotating to the cutting position, a connection member which is arranged between the tape sticking plate and the tape pressing member, wherein it makes the tape sticking plate rotate to be pushed by the box body, thereby making the both of them work with each other so as to rotate to the position wherein the tape pressing member can press the tape to the box body, a first elastic member in which one end thereof is arranged at the cutter and the other end thereof is arranged at the pressing member or the tape sticking plate, so as to make the cutter rotate to a direction of the cutting position when the pressing member and the tape sticking plate work with each other, a second elastic member in which one end thereof is arranged at the cutter and the other end thereof is arranged at the side plate, so as to urge the cutter in a direction of the storing position by means of an elastic force which is stronger than the force of the first elastic member when the pressing member and the tape sticking plate do not work with each other, a third elastic member in which one end thereof is arranged at the tape pressing member or the tape sticking plate and the other end thereof is arranged at the side plate, so as to urge the tape sticking plate to a position wherein an edge portion of the tape is stuck to a front face of the carried box body, wherein, when the tape sticking plate and the tape pressing member work with each other according to the progress of the box body, the elastic force of the first elastic member is stronger than the force of the second elastic member, thereby making the cutter rotate to the cutting position.

2. A sticking apparatus of claim 1, wherein the side plate is also provided with an operation lever so as to rotate by means of contacting with the progressing box body and the other end of the first elastic member is arranged at the operation lever, when the operation lever rotates according to the progress of the box body, the elastic force of the first elastic member is stronger than the force of the second elastic member, thereby making the cutter rotate to the cutting position.

3. A sticking apparatus of claim 1, wherein the side plate is also provided with a guard which holds the rotating locus of an edge of the cutter blade and faces to the forward direction of the rotation of the edge of the cutter blade which is escaped to the storing position.

4. A sticking apparatus of claim 2, wherein the side plate is also provided with a guard which holds the rotating locus of an edge of the cutter blade and faces to the forward direction of rotation of the edge of the cutter blade which is escaped to the storing position.

5. A sticking apparatus of claim 1, wherein the first elastic member, the second elastic member and the third elastic member are springs.

6. A sticking apparatus of claim 1, wherein the first elastic member, the second elastic member and the third elastic member are rubbers.

7. A sticking apparatus of claim 2, wherein the first elastic member, the second elastic member and the third elastic member are springs.

8. A sticking apparatus of claim 2, wherein the first elastic member, the second elastic member and the third elastic member are rubbers.

9. A sticking apparatus of claim 1, wherein the cutter is provided with a cutter cam which prevents the blade edge thereof from interfering with the box body by protruding forward over the blade edge.

10. A sticking apparatus of claim 2, wherein the cutter is provided with a cutter cam which prevents the blade edge thereof from interfering with the box body by protruding forward over the blade edge.

11. A packing tape sticking apparatus wherein, in order to seal butt portions of a pair of closed flaps of a carried box body, an adhesive tape for packing which is drawn from a roll according to a progress of the box body, is stuck to the butt portions thereof so as to cut the tape after the tape is stuck in a fixed length, comprising a pair of side plates, a tape sticking plate which is rotatably arranged between the side plates and located at one end of the plates so as to stick an end portion of the tape to a front face of the carried box body, a tape pressing member which is rotatably arranged between the side plates and located at the other end of the plates so as to press the tape stuck to the box body according to the progress of the box body, a cutter which is arranged between the tape sticking plate and the tape pressing member so as to rotate between a storing position between the side plates and a cutting position protruded from the side plates, thereby cutting the tape in a state of having a length left backward in the butt portions when it is rotating to the cutting position, a connection member which is arranged between the tape sticking plate and the tape pressing member, wherein it makes the tape sticking plate rotate to be pushed by the box body, thereby making the tape pressing member and tape sticking plate work with each other so as to rotate to the position wherein the tape pressing member can press the tape to the box body, a first elastic member in which one end thereof is arranged at the cutter and the other end thereof is arranged at the pressing member or the tape sticking plate, so as to make the cutter rotate to a direction of the cutting position when the pressing member and the tape sticking plate work with each other, a second elastic member in which one end thereof is arranged at the cutter and the other end thereof is arranged at the side plate, so as to urge the cutter in a direction of the storing position by means of an elastic force which is stronger than the force of the first elastic member when the pressing member and the tape sticking plate do not work with each other, a third elastic member in which one end thereof is arranged at the tape pressing member or the tape sticking plate and the other end thereof is arranged at the side plate, so as to urge the tape sticking plate to a position wherein an edge portion of the tape is stuck to a front face of the carried box body, a guard which is arranged at the side plate so as to hold the rotating locus of an edge of the cutter blade and face to the forward direction of the rotation of the edge of the cutter blade which is located in the storing position, a cutter cam arranged at the cutter which prevents the blade edge thereof from interfering with the box body by protruding forward over the blade edge, wherein, when the tape sticking plate and the tape pressing member work with each other according to the progress of the box body, the elastic force of the first elastic member is stronger than the force of the second elastic member, thereby making the cutter rotate to the cutting position.

12. A packing tape sticking apparatus wherein, in order to seal butt portions of a pair of closed flaps of a carried box body, an adhesive tape for packing which is drawn from a roll according to a progress of the box body, is stuck to the butt portions thereof so as to cut the tape after the tape is stuck in a fixed length, comprising a pair of side plates, a tape sticking plate which is rotatably arranged between the side plates and located at one end of the plates so as to stick an end portion of the tape to a front face of the carried box body, a tape pressing member which is rotatably arranged between the side plates and located at the other end of the plates so as to press the tape stuck to the box body according to the progress of the box body, a cutter which is arranged between the tape sticking plate and the tape pressing member so as to rotate between a storing position between the side plates and a cutting position protruded from the side plates, thereby cutting the tape in a state of having a length left backward in the butt portions when it is rotating to the cutting position, a connection member which is arranged between the tape sticking plate and the tape pressing member, wherein it makes the tape sticking plate rotate to be pushed by the box body, thereby making the tape pressing member and tape sticking plate work with each other so as to rotate to the position wherein the tape pressing member can press the tape to the box body, an operation lever arranged at the side plate to rotate by means of contacting the progressing box body, a first elastic member in which one end thereof is arranged at the cutter and the other end thereof is arranged at the operation lever, so as to make the cutter rotate to a direction of the cutting position when the operation lever rotates, a second elastic member in which one end thereof is arranged at the cutter and the other end thereof is arranged at the side plate, so as to urge the cutter in a direction of the storing position by means of an elastic force which is stronger than the force of the first elastic member when the pressing member and the tape sticking plate do not work with each other, a third elastic member in which one end thereof is arranged at the tape pressing member or the tape sticking plate and the other end thereof is arranged at the side plate, so as to urge the tape sticking plate to a position wherein an edge portion of the tape is stuck to a front face of the carried box body, a guard which is arranged at the side plate so as to hold the rotating locus of an edge of the cutter blade and face to the forward direction of the rotation of the edge of the cutter blade which is located in the storing position, a cutter cam arranged at the cutter which prevents the blade edge thereof from interfering with the box body by protruding forward over the blade edge, wherein, when the operation lever rotates according to the progress of the box body, the elastic force of the first elastic member is stronger than the force of the second elastic member, thereby making the cutter rotate to the cutting position.

13. A sticking apparatus of claim 11, wherein the first elastic member, the second elastic member and the third elastic member are springs.

14. A sticking apparatus of claim 11, wherein the first elastic member, the second elastic member and the third elastic member are rubbers.

15. A sticking apparatus of claim 12, wherein the first elastic member, the second elastic member and the third elastic member are springs.

16. A sticking apparatus of claim 12, wherein the first elastic member, the second elastic member and the third elastic member are rubbers.

* * * * *